US007042423B2

(12) United States Patent
Iwami

(10) Patent No.: US 7,042,423 B2
(45) Date of Patent: May 9, 2006

(54) DRIVING APPARATUS FOR A DISPLAY PANEL

(75) Inventor: Takashi Iwami, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 301 days.

(21) Appl. No.: 10/365,604

(22) Filed: Feb. 13, 2003

(65) Prior Publication Data

US 2003/0169215 A1 Sep. 11, 2003

(30) Foreign Application Priority Data

Feb. 28, 2002 (JP) ..... 2002-054058
Sep. 19, 2002 (JP) ..... 2002-273327

(51) Int. Cl.
*G09G 3/28* (2006.01)

(52) U.S. Cl. ..... 345/63; 345/62; 345/66; 345/208; 345/212

(58) Field of Classification Search ..... 345/63, 345/60, 62, 66, 204, 208, 691–692, 212
See application file for complete search history.

(56) References Cited

U.S. PATENT DOCUMENTS 6,452,590 B1 * 9/2002 Awamoto et al. ..... 345/211
6,738,033 B1 * 5/2004 Hibino et al. ..... 345/60
2001/0020923 A1 * 9/2001 Homma ..... 345/60
2002/0030450 A1 * 3/2002 Yoo et al. ..... 315/169.1

FOREIGN PATENT DOCUMENTS

EP 0 837 443 4/1998
EP 1 139 323 10/2001
EP 1 187 088 3/2002
EP 1 256 925 11/2002
EP 1 260 956 11/2002
EP 1 274 064 1/2003
JP 1139323 * 10/2001

OTHER PUBLICATIONS

EP Search Report for EP 03 00 3104, Munich, Jun. 5, 2003, Gudlach, H.

* cited by examiner

*Primary Examiner*—Amr A. Awad
*Assistant Examiner*—Leonid Shapiro
(74) *Attorney, Agent, or Firm*—Sughrue Mion, PLLC

(57) ABSTRACT

A driving apparatus for a display panel generates a cell data comprising a bit series per each column electrode of a display panel. The cell data indicates light emitting or non-light emitting in each cell on a column electrode in accordance with a picture signal. The apparatus generates a resonating amplitude signal having a specified minimum power source voltage by a function of resonance. The apparatus generates power pulses in sequence having a period corresponding to one bit of the cell data by giving a specified maximum electrical potential during a rising period and a falling period of the resonating amplitude signal. The apparatus provided in each column electrode determines a logic level of the bit series of the cell data in order of the bit series, and supplies the power pulse to a corresponding column electrode as a driving pulse when the bit indicates the logic level of light emitting. The apparatus determines a magnitude of power during a writing period of the cell data, and varies the rising period and the falling period of the resonating amplitude signal depending on a result of the determining. The apparatus can save power consumption during a cell data writing step.

13 Claims, 7 Drawing Sheets

PRIOR ART

PRIOR ART

DRIVING APPARATUS FOR A DISPLAY PANEL

BACKGROUND OF THE INVENTION

1) Field of the Invention

The present invention relates to a driving apparatus for a display panel having a capacitive load such as an AC driving type plasma display panel (hereinafter referred to as PDP) or an electroluminescence display panel (hereinafter referred to as ELP).

2) Description of the Related Art

Recently, display apparatuses using capacitive light emitting devices such as a PDP or an ELP have been put into practical use as a wall-mounted TV.

FIG. 1 of the accompanying drawings is a diagram showing a schematic structure of the plasma display apparatus using the PDP.

In FIG. 1, a PDP 10 has pairs of row electrodes $Y_1$–$Y_n$ and row electrodes $X_1$–$X_n$ in which a row electrode pair corresponding to each row (the first to the n-th rows) of one screen is formed by a pair of row electrodes X and Y. Further, column electrodes $Z_1$–$Z_m$ corresponding to the individual columns (the first to the m-th columns) of one screen are formed on the PDP 10 so as to perpendicularly cross the row electrode pairs and to sandwich a dielectric material layer (not shown) and a discharge space (not shown). A discharge cell serving as one pixel is formed in a crossing portion of one pair of row electrodes X and Y, and one column electrode Z.

Each discharge cell has only two states, i.e., "light emmission" and "non-light emmisssion", depending on whether a discharge occurs in the discharge cell or not. That is to say, the discharge cell expresses only two gradating luminances, i.e., the lowest luminance (non-light emitting state) and the highest luminance (light emitting state).

A driving apparatus 100 is thus utilized to execute a gradation driving using a subfield method in order to obtain the halftone luminance corresponding to a video signal supplied to the PDP 10 having the light emitting devices, i.e., the discharge cells.

According to the subfield method, the supplied video signal is converted into pixel data of N bits corresponding to each pixel, and a display period of one field is divided into N subfields in correspondence with each bit digit of those N bits. The number of times of discharge corresponding to a weight of the subfield is allocated to each subfield. The discharge is selectively caused only in the subfield based on the video signal. The halftone luminance corresponding to the video signal is obtained by the total number of times of the discharge caused (in one field display period) in each subfield.

A selective erasure address method is known as a method to gradation-drive the PDP with the subfield method.

FIG. 2 of the accompanying drawings is a diagram showing application timing of various drive pulses to be applied by the driving apparatus 100 to the column electrodes and row electrodes of the PDP 10 in one subfield when the gradation-driving is executed based on the selective erasure address method.

First, the driving apparatus 100 simultaneously applies reset pulses $RP_X$ of negative polarity to the row electrodes $X_1$–$X_n$, and, reset pulses $RP_Y$ of positive polarity to the row electrodes $Y_1$–$Y_n$ (all-resetting step Rc).

All discharge cells in the PDP 10 are reset-discharged in response to the applying of the reset pulses $RP_X$ and $RP_Y$ and wall charges of a predetermined amount are uniformly formed in each discharge cell. All of the discharge cells are, thus, initialized to "light emitting cells".

The driving apparatus 100 converts the supplied video signal into cell data of, for example, 8 bits per each pixel (cell). The driving apparatus 100 obtains cell data bits by dividing the cell data according to each bit digit and generates a driving pulse having a pulse voltage corresponding to a logic level of the cell data bit. For example, the driving apparatus 100 generates a cell data pulse DP of a high voltage when the cell data bit is set to logic level "1" and of a low voltage (0 volt) when the cell data bit is set to logic level "0". The driving apparatus 100 applies the cell data pulse groups $DP_{11-1m}$, $DP_{21-2m}$, $DP_{31-3m}$, . . . and $DP_{n1-nm}$, which are formed by grouping the cell data pulses in each row (m pulses) for all the cell data pulses $DP_{11}$–$DP_{nm}$ in one screen (n rows×m columns), to the column electrodes $Z_1$–$Z_m$ one by one as shown in FIG. 2. In each application timing of the cell data pulse group DP, the driving apparatus 100 further generates a scan pulse SP as shown in FIG. 2, which is sequentially applied to the row electrodes $Y_1$–$Y_n$ (cell data writing step Wc). In this instance, a discharge (selective erasure discharge) occurs only in the discharge cells in crossing portions of the "rows" to which the scan pulses SP have been applied and the "columns" to which the high voltage cell data pulses DP have been applied, and the wall charges remaining in those discharge cells are selectively erased. The discharge cells initialized to the status of "light emitting cells" in the all-resetting step Rc are, consequently, shifted to "non-light emitting cells". The selective erasure discharge as mentioned above does not occur in the discharge cells formed in crossing portions of the "rows" and the "columns" to which the cell data pulses DP of the low voltage have been applied, even though the scan pulses SP have been applied to the "rows" of the discharge cells. Thus the status initialized in the all-resetting step Rc, namely, the status of "light emitting cell" is maintained.

The driving apparatus 100 applies sustain pulses $IP_X$ of positive polarity repetitively to the row electrodes $X_1$–$X_n$ as shown in FIG. 2, and the driving apparatus applies a sustain pulse $IP_Y$ of positive polarity repetitively to the row electrodes $Y_1$–$Y_n$ as shown in FIG. 2 during a period when no sustain pulse $IP_X$ is applied to the row electrodes $X_1$–$X_n$ (light emission sustaining step Ic).

In this instance, only the discharge cells in which the wall charges remain, namely, only the "light emitting cells" discharge (sustain-discharge) every time the sustain pulses $IP_X$ and $IP_Y$ are alternately applied. That is, only the discharge cells set as "light emitting cells" in the cell data writing step Wc repeat the light emission due to the sustain-discharge only the number of times corresponding to the weight of this subfield and sustain the light emitting state. The number of applying times of the sustain pulses $IP_X$ and $IP_Y$ has been previously setup in accordance with the weight of each subfield.

The driving apparatus 100 applies erasing pulses EP to the row electrodes $X_1$–$X_n$ as shown in FIG. 2 (erasing step E). All of the discharge cells are, thus, allowed to erasure-discharge at once, thereby extinguishing the wall charges remaining in each discharge cell.

By executing the series of operations as mentioned above a plurality of times in one field, the halftone luminance corresponding to the video signal can be derived.

However, when the cell data pulse is applied to the column electrodes of the capacitive display panel such as a PDP and an ELP, the charge or discharge is necessary for every row in writing data even on the row electrodes where no data is written. Furthermore, the charge or discharge is caused in the capacitance existing between the adjacent column electrodes. Therefore there is a problem that a large amount of electric power is consumed in writing the cell data.

SUMMARY OF THE INVENTION

An object of the present invention is to provide a driving apparatus for a display panel that has a capability to save the electric power consumption in a cell data writing step.

According to one aspect of the present invention, there is provided a driving apparatus for a display panel which applies a driving pulse based on a picture signal on each column electrode of a display panel having a plurality of row electrodes and a plurality of column electrode perpendicularly crossing said row electrodes so as to form the cells with capacitive load in each crossing portion of the electrodes, the apparatus comprising: cell data generating means which generates cell data having a series of bits indicating light emitting state or non-light emitting state of each cell on each column electrode of the display panel based on said picture signal; pulse generating means which subsequently generates a power pulse having a pulse width corresponding to one bit of said cell data; and pulse supplying means provided on each column electrode which supplies said power pulse as said driving pulse to a cell of a column electrode when a corresponding bit in the cell data for the column electrode indicates a logic level of light emitting; wherein said pulse generating means has determining means to determine a magnitude of a power during a writing period of said cell data and adjusting means which varies a rising period and a falling period of said power pulse depending on a determining result by said determining means.

DETAILED DESCRIPTION OF THE INVENTION

Embodiments of the present invention will be described hereinafter in detail with reference to the drawings.

Figure 3:
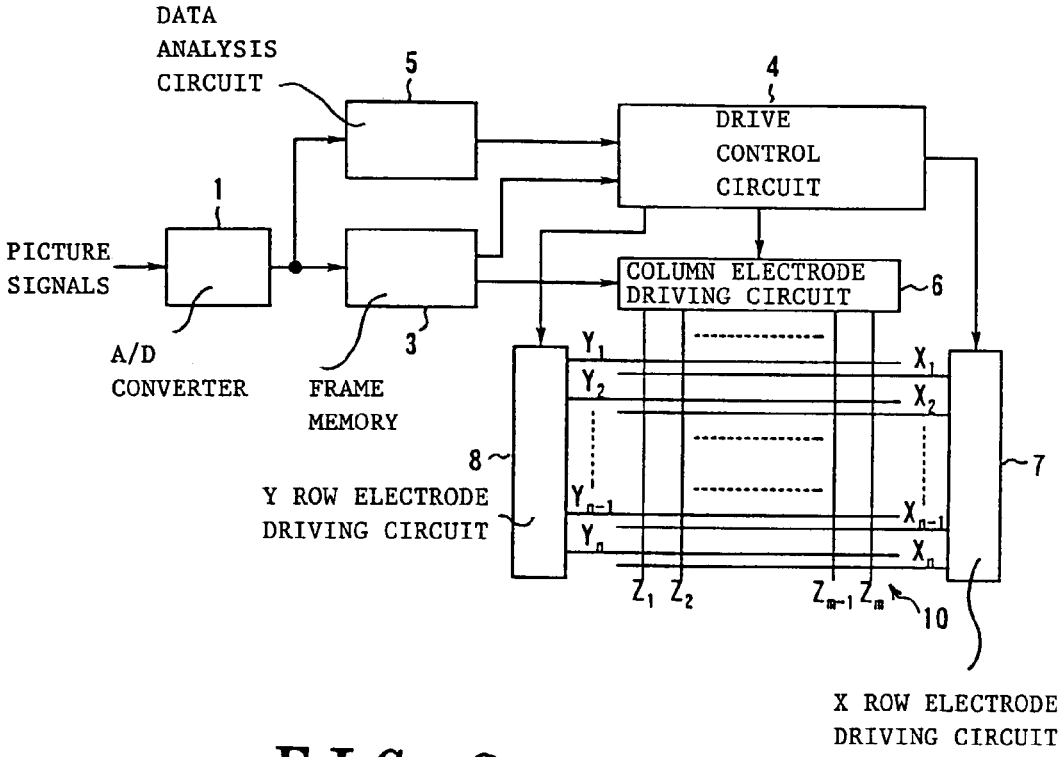
FIG. 3 is a block diagram showing a structure of a driving apparatus according to one embodiment of the present invention.

FIG. 3 is a diagram showing the structure of a display apparatus including a display panel according to one embodiment of the invention. The display apparatus comprises a PDP 10 and a driving section (driving apparatus) having various functional modulus.

The PDP 10 has pairs of row electrodes $Y_1$–$Y_n$ and row electrodes $X_1$–$X_n$ in which a row electrode pair corresponding to each row (the first to the n-th rows) of one screen is formed by an X, Y pair. Further, column electrodes $Z_1$–$Z_m$ corresponding to the individual columns (the first to the m-th columns) of one screen are formed on the PDP 10 so as to perpendicularly cross the row electrode pairs and to sandwich a dielectric material layer (not shown) and a discharge space (not shown). A discharge cell $C_{(i,\ j)}$ is formed in a crossing portion of one pair of row electrodes X and Y and one column electrode Z.

The driving section comprises an A/D converter 1, a frame memory 3, a drive control circuit 4, a data analysis circuit 5, a column electrode driving circuit 6, an X row electrode driving circuit 7 and a Y row electrode driving circuit 8.

The A/D converter 1 samples a supplied analog video signal to convert it to a cell data PD of, for example, 8 bits corresponding to each cell, and supplies the cell data PD to the frame memory 3. The frame memory 3 sequentially writes the cell data PD in accordance with a write signal supplied from the drive control circuit 4. On finishing the writing step of the cell data PD, which consists of n×m in number in one screen (frame), namely, starting from the cell data $PD_{11}$ corresponding to the pixel at the first column and the first row up to the cell data $PD_{nm}$ corresponding to the pixel at the n-th row and the m-th column, the frame memory 3 executes reading as described below. First of all, the frame memory 3 holds the first bit of the cell data $PD_{11}$–$PD_{nm}$ as cell driving data bits $DB1_{11}$–$DB1_{nm}$, respectively, reads the bits for one display line at a time in accordance with a read address supplied from the drive control circuit 4, and supplies the bits to the column electrode driving circuit 6. The frame memory 3, secondly, holds the second bit of the cell data $PD_{11}$–$PD_{nm}$ as cell driving data bits $DB2_{11}$–$DB2_{nm}$, respectively, reads the bits for one display line at a time in accordance with a read address supplied from the drive control circuit 4, and supplies the bits to the column electrode driving circuit 6. In a similar manner, the frame memory 3 holds the third through N-th bit of the cell data $PD_{11}$–$PD_{nm}$ as cell driving data bits DB3 through DB(N) reads the bits for one display line at a time in each data bit DB, and supplies the bits to the column electrode driving circuit 6.

The display data analysis circuit 5 determines whether the inversions in logic level of cell data based on the cell data $PD_{11}$–$PD_{nm}$ supplied in sequence from the A/D converter 1 is more frequent or not between pixels adjoining each other along the column direction. A signal resulting from the determining operation is supplied to the drive control circuit 4. A video picture having many inversions in logic level of cell data is, for example, a video picture displayed on a personal computer or a video picture of a checkered pattern. A video picture having fewer inversions in logic level of cell data is, for example, a normal video signal such as a television picture.

The drive control circuit 4 controls the writing of the cell data into the frame memory 3 and the reading of the cell data bits from the frame memory 3. The drive control circuit 4 then supplies various switching signals to the column electrode driving circuit 6, the X row electrode driving circuit 7 and the Y row electrode driving circuit 8 in synchronization with the writing and the reading control so as to gradation-drive the PDP 10 in accordance with a light emitting drive format of a subfield method as shown in FIG. 2.

Figure 1:
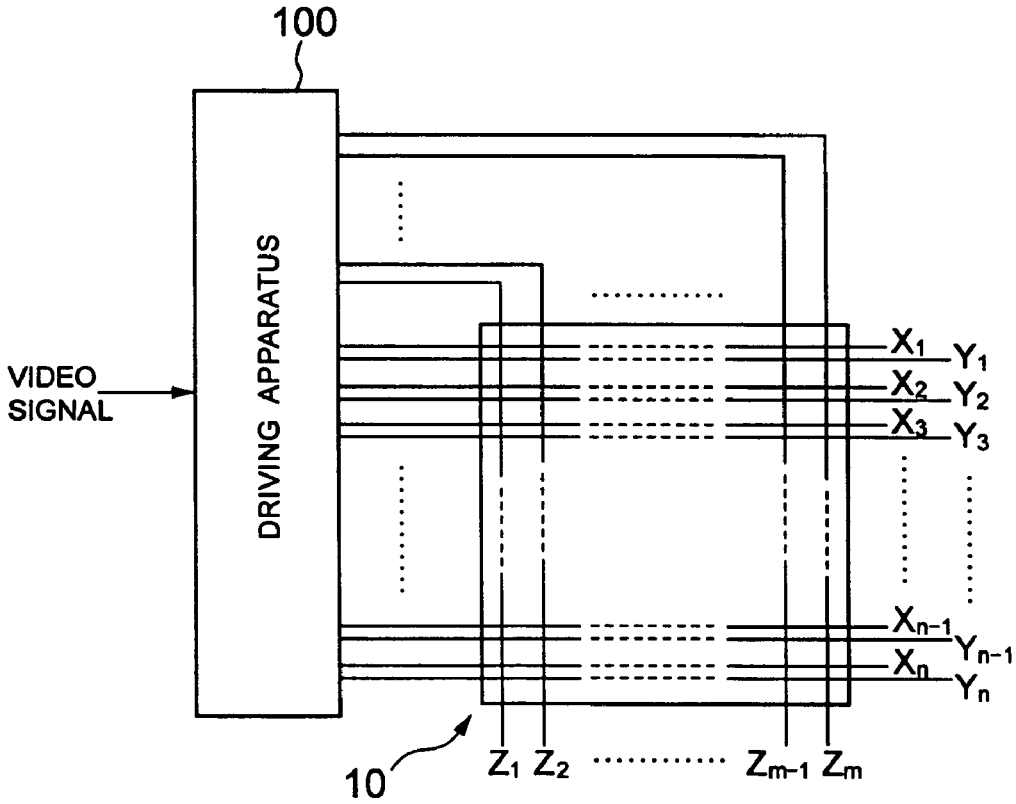
FIG. 1 shows a schematic structure of the display apparatus using the PDP.
Figure 2:
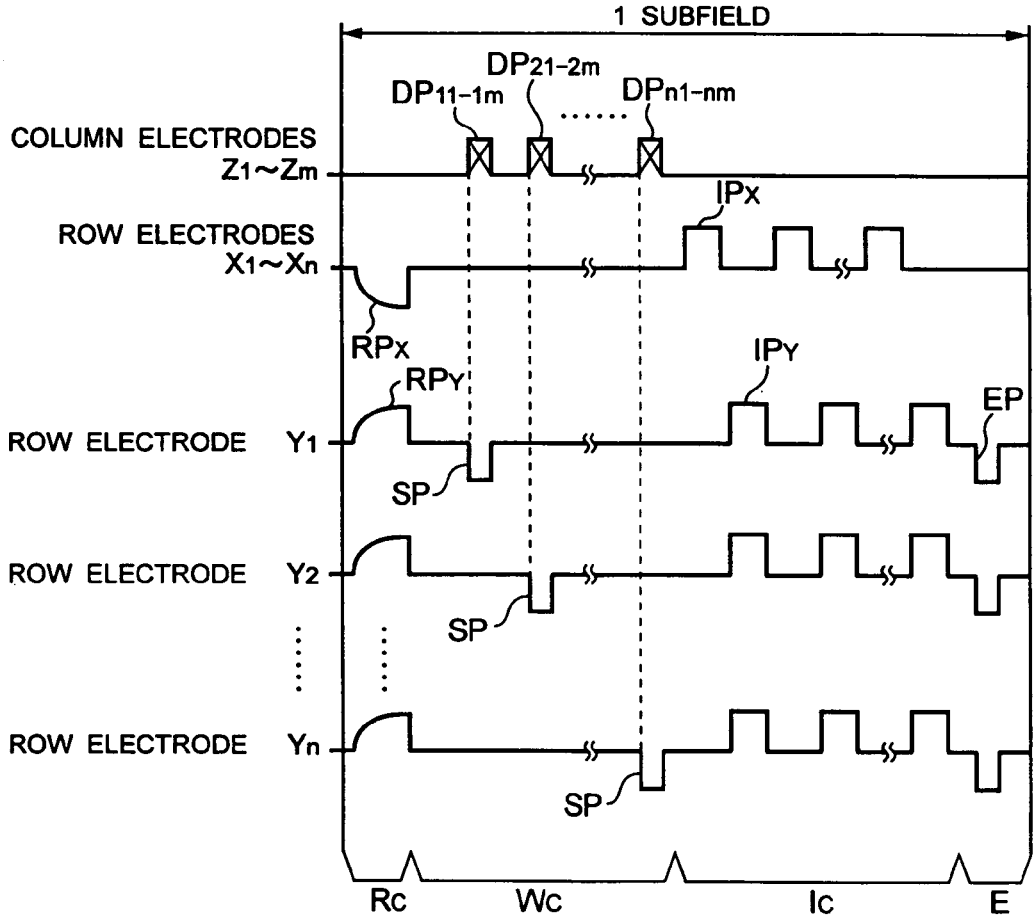
FIG. 2 shows application timing of various drive pulses to the PDP in one subfield.

In the light emitting drive format shown in the FIG. 2, a display period of one field is divided into N subfields SF1-SF(N), then the cell data writing step Wc and the light emission sustaining step Ic described above are performed in each subfield. Moreover, the all-resetting step Rc is performed in the first subfield SF1 only, and the erasing step E is performed in the last subfield SF(N) only which extinguishes the wall charges remaining in the discharge cells.

The X row electrode driving circuit 7 and the Y row electrode driving circuit 8 generate various driving pulses according to various switching signals supplied from the drive control circuit 4, and apply the pulses to the row electrodes X and Y of the PDP 10.

Figure 4:
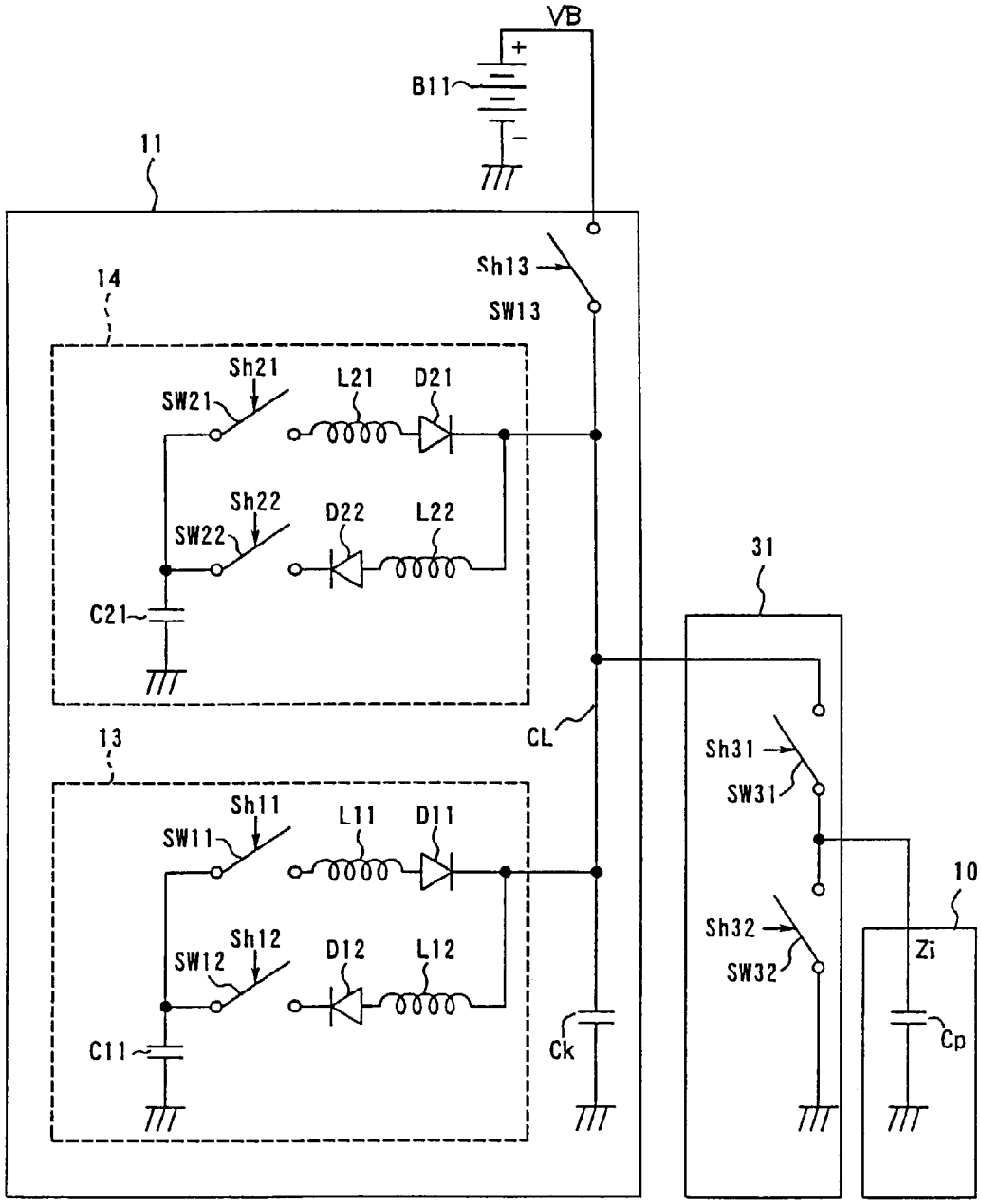
FIG. 4 is a circuit diagram showing a structure of a column electrode driving circuit in the apparatus shown in FIG. 3.

FIG. 4 is a diagram showing the internal structure of the column electrode driving circuit 6. Since a plurality of identical circuits is provided in the column electrode driving circuit 6 with a number equal to that of the column electrodes $Z_1$–$Z_m$ of the PDP 10, the column electrode driving circuit 6 in FIG. 4 illustrates only the circuit corresponding to the column electrode Zi (one of $Z_1$–$Z_m$) of the PDP 10.

The column electrode driving circuit 6 in FIG. 4 has a resonance circuit 11 and a pulse generating circuit 31. The resonance circuit 11 has a first resonance block 13 and a second resonance block 14 which are both connected to a common line CL.

The first resonance block 13 comprises switching elements SW11 and SW12, coils L11 and L12, diodes D11 and D12, and a capacitor C11. The switching element SW11, the coil L11 and the diode D11 are connected in series to form a circuit in the described order. One side of the diode D11, which is connected to the coil L11, is an anode. One end of the series circuit having the diode D11 is connected to the common line CL, and the other end having the switching element SW11 is connected to a ground potential via the capacitor C11. In a similar manner, the switching element SW12, the diode D12 and the coil L12 are connected in series in the described order. One end of the diode D12, which is connected to the coil L12, is an anode. One end of the series circuit having the coil L12 is connected to the common line CL, and the other end having the switching element SW12 is connected to a ground potential via the capacitor C11.

The second resonance block 14 comprises switching elements SW21 and SW22, coils L21 and L22, diodes D21 and D22, and a capacitor C21. The switching element SW21, the coil L21 and the diode D21 are connected in series to form a circuit in the described order. One side of the diode D21, which is connected to the coil L21, is an anode. One end of the series circuit having the diode D21 is connected to the common line CL, and the other end having the switching element SW21 is connected to a ground potential via the capacitor C21. In a similar manner, the switching element SW22, the diode D22 and the coil L22 are connected in series in the described order. One end of the diode D22, which is connected to the coil L22, is an anode. One end of the series circuit having the coil L22 is connected to the common line CL, and the other end having the switching element SW22 is connected to a ground potential via the capacitor C21.

A positive terminal of a power source B11 is connected to the common line CL via the switching element SW13. It is assumed that the common line CL has a circuit capacitance Ck as shown in FIG. 4.

The pulse generating circuit 31 includes switching elements SW31 and SW32. The switching elements SW31 and SW32 are connected in series to form a circuit, and one end of the series circuit having the switching element SW31 is connected to the common line CL and the other end having the switching element SW32 is connected to a ground potential. A connecting line between the switching elements SW31 and SW32 is connected to the column electrode Zi of the PDP 10. It is assumed that the column electrode Zi has a load capacitance Cp.

In one of any subfields within one field, a series of bits of cell bit data DB for the column electrode Zi, read from the frame memory 3 by the reading control of the drive control circuit 4, is expressed as $DB_{1i}$, $DB_{2i}$, $DB_{3i}$, $DB_{4i}$, . . . , and $DB_{ni}$. When the logic level of all cell bit data DB in a series of bits for the column electrode Zi are expressed as "1", i.e., $DB_{1i}=1$, $DB_{2i}=1$, $DB_{3i}=1$, $DB_{4i}=1$, . . . , and $DB_{ni}=1$, or the logic level of all cell bit data in a series of bits are expressed as "0", i.e., $DB_{1i}=0$, $DB_{2i}=0$, $DB_{3i}=0$, $DB_{4i}=0$, . . . , and $DB_{ni}=0$, the inversion of the logic level in the cell bit data is regarded to be in a less frequent state. On the other hand, when the logic levels "1" and "0" alternately appear, i.e., $DB_{1i}=1$, $DB_{2i}=0$, $DB_{3i}=1$, $DB_{4i}=0$, . . . , $DB_{n-1i}=1$, and $DB_{ni}=0$, or $DB_{1i}=0$, $DB_{2i}=1$, $DB_{3i}=0$, $DB_{4i}=1$, . . . , $DB_{n-1i}=0$, and $DB_{ni}=1$, the inversion of the logic level in the cell bit data is regarded to be in a more frequent state.

The state of the inversion of the logic level of the cell bit data is analyzed (determined) by the data analysis circuit 5. The drive control circuit 4 supplies switching signals Sh11, Sh12, Sh13, Sh21, Sh22, Sh31 and Sh32 to the switching elements SW11, SW12, SW13, SW21, SW22, SW31 and SW32, respectively, in accordance with the data of cell bit data DB and the result of the analysis (determination) by the data analysis circuit 5, so as to perform an on/off control.

Each bit of cell bit data DB is output from the column electrode driving circuit 6 to the column electrode Zi in synchronization with the scanning by the row electrode driving circuits 7 and 8 in order of $DB_{1i}$, $DB_{2i}$, $DB_{3i}$, $DB_{4i}$, . . . , and $DB_{ni}$ as respective data pulses $DP_{1i}$, $DP_{2i}$, $DP_{3i}$, $DP_{4i}$, . . . , and $DP_{ni}$ corresponding to the logic level of the bit. It should be noted that each data pulse $DP_{1i}$ through $DP_{ni}$ is generated only when the logic level of the corresponding $DB_{1i}$ through $DB_{ni}$ is "1".

An electrical potential on the common line CL generated during the scanning of each row electrode, i.e., a pulse of the power supply, has a rising period, a constant level period, and a falling period.

Figure 5:
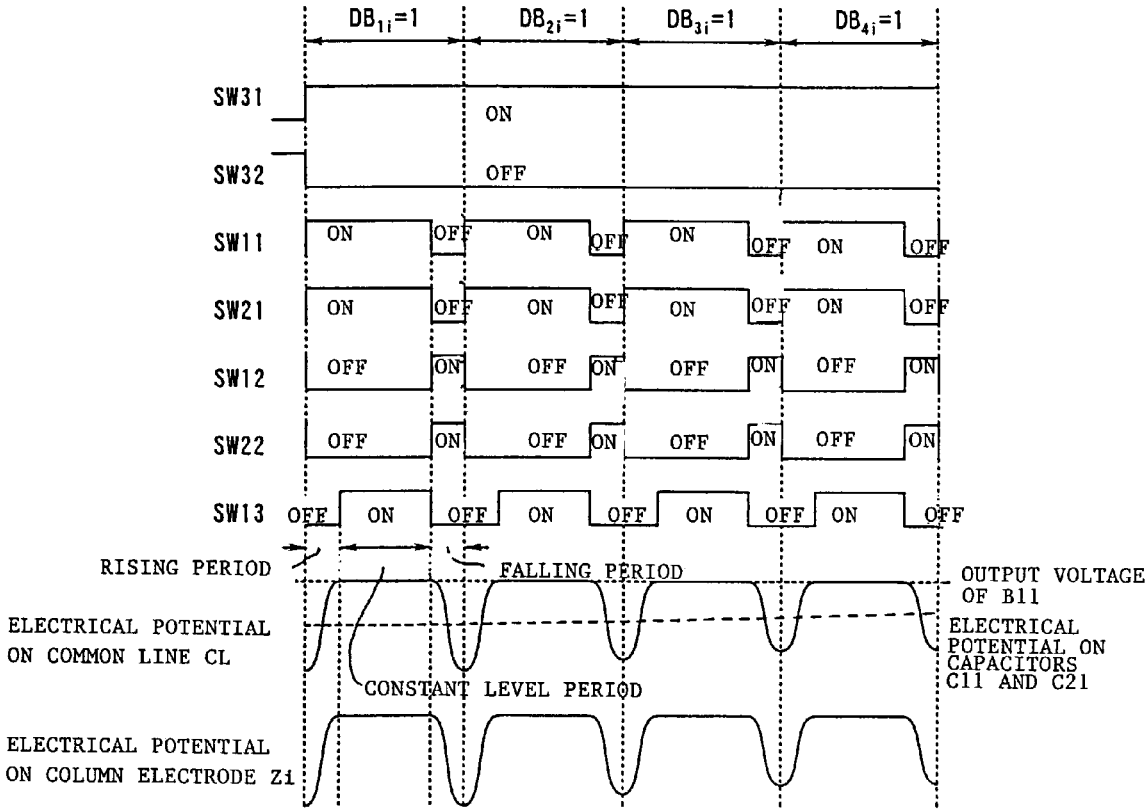
FIG. 5 is a diagram showing on/off states of each switching element by a simultaneous single step resonance operation and variations of electrical potentials on a common line and a column electrode, when inversion of a logic level in cell bit data is less frequent.

First of all, when the logic level of all cell bit data DB is "1" as shown in FIG. 5, i.e., in a state in which the inversion of the cell bit data is less frequent, the switching elements SW31 and SW32 are turned on and off, respectively, because $DB_{1i}=1$ during a scanning period on a first row electrode by the row electrode driving circuits 7 and 8.

As the scanning period on the first row electrode (first display line) starts, the rising period starts which turns on the switching elements SW11 and SW21 simultaneously. Turning on the switching element SW11 allows an electrical potential (current) developed at the capacitor C11 to be applied (flow) to the circuit capacitance Ck via the switching element SW11, the coil L11, the diode D11 and the common line CL. The electrical potential (current) is also applied (flow) to the load capacitance Cp of the column electrode Zi via the switching element SW31. Turning on the switching element SW21 allows an electrical potential (current) developed at the capacitor C21 to be applied (flow) to the circuit capacitance Ck via the switching element SW21, the coil L21, the diode D21 and the common line CL. The electrical potential (current) is also applied (flow) to the load capacitance Cp of the column electrode Zi via the switching element SW31. Specifically, a rising current is applied to the circuit capacitance Ck and the load capacitance Cp from the first resonance block 13 and the second resonance block 14 in order to charge the circuit capacitance Ck and the load capacitance Cp. The electrical potential on the common line CL and the column electrode Zi is gradually increased during the rising period depending on time constants of the coils L11 and L12, the circuit capacitance Ck, and the load capacitance Cp.

Subsequently, when the constant level period starts, the switching element SW13 is turned on, which applies an electrical potential VB directly derived from the power source B11 to the circuit capacitance Ck via the common line CL. The power source voltage is also applied to the load capacitance Cp via the switching element SW31 and the column electrode Zi. Accordingly, the electrical potential on the common line CL and the column electrode Zi is kept at a maximum potential equal to the power source voltage VB.

When the falling period starts, the switching element SW13 is turned off, the switching elements SW11 and SW21 are turned off simultaneously, and, the X switching elements SW12 and SW22 are turned on. Turning on the switching element SW12 allows an electrical potential (current) developed at the circuit capacitance Ck and the load capacitance Cp to be applied (flow) to the capacitor C11 via the switching element SW31 (only from the load capacitance Cp), the common line CL, the coil L12, the diode D12, and the switching element SW12. Turning on the switching element SW22 allows an electrical potential (current) developed at the circuit capacitance Ck and the load capacitance Cp to be applied (flow) to the capacitor C21 via the switching element SW31 (only from the load capacitance Cp), the common line CL, the coil L22, the diode D22, and the switching element SW22. Specifically, the falling current is applied to the first resonance block 13 and the second resonance block 14 from the circuit capacitance Ck and the load capacitance Cp in order to charge the capacitors C11 and C21. The electrical potential on the common line CL and the column electrode Zi is gradually decreased during the falling period depending on time constants of the coils L12 and L22, the circuit capacitance Ck, and the load capacitance Cp. Accordingly, the data pulse $DP_{1i}$ corresponding to $DB_{1i}=1$ is formed on the column electrode Zi.

On finishing the scanning period on the first row electrode (first display line), a scanning on a second row electrode (second display line) is initiated to repeat the rising period which corresponds to $DB_{2i}=1$, followed by the constant level period, and the falling period as described above.

Figure 6:
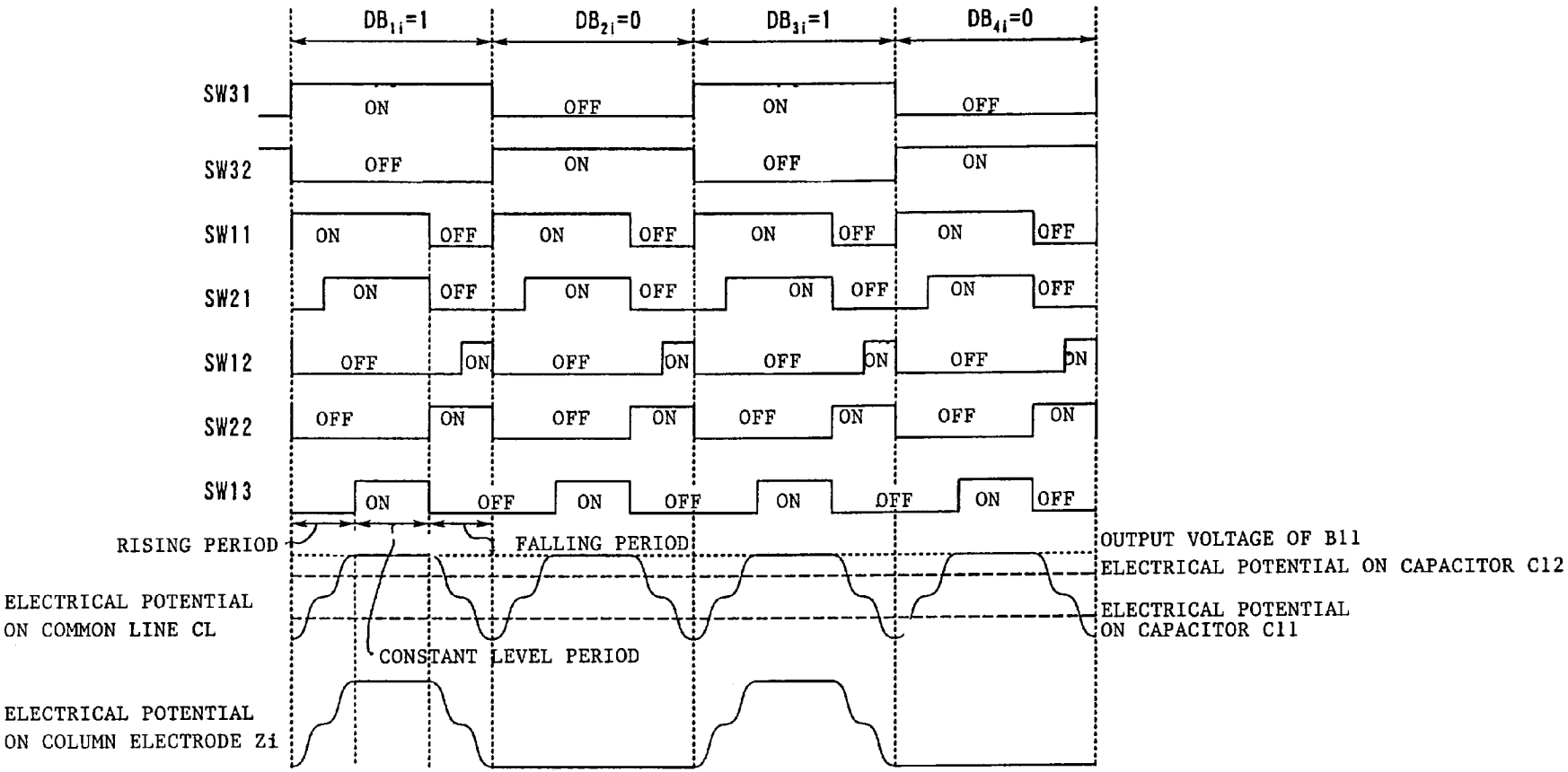
FIG. 6 is a diagram showing on/off states of each switching element by a complex resonance operation and variations of electrical potentials on the common line and the column electrode, when the inversion of the logic level in cell bit data is more frequent.

Next, when the logic level of the cell bit data DB becomes "1" and "0" alternately as shown in FIG. 6, i.e., in a state of which the inversion of the cell bit data is more frequent, the switching elements SW31 and SW32 are turned on and off, respectively, because $DB_{1i}=1$ during a scanning period on a first row electrode by the row electrode driving circuits 7 and 8.

As the scanning period on the first row electrode (first display line) starts, the rising period starts which firstly turns on the switching element SW11. Turning on the switching element SW11 allows an electrical potential (current) developed at the capacitor C11 to be applied (flow) to the circuit capacitance Ck via the switching element SW11, the coil L11, the diode D11 and the common line CL. The electrical potential (current) is also applied (flow) to the load capacitance Cp of the column electrode Zi via the switching element SW31. Specifically, a rising current is applied to the circuit capacitance Ck and the load capacitance Cp from the first resonance block 13 in order to charge the circuit capacitance Ck and the load capacitance Cp. The electrical potential on the common line CL and the column electrode Zi is gradually increased during the rising period by the first resonance block 13 depending on time constants of the coil L11, the circuit capacitance Ck, and the load capacitance Cp.

When the electrical potential on the common line CL and the column electrode Zi exhibits a substantially stable condition after the rising period, the switching element SW21 is turned on with the switching element SW11 being kept turned on. Turning on the switching element SW21 allows an electrical potential (current) developed at the capacitor C21 to be applied (flow) to the circuit capacitance Ck via the switching element SW21, the coil L21, the diode D21 and the common line CL. The electrical potential (current) is also applied (flow) to the load capacitance Cp of the column electrode Zi via the switching element SW31. Specifically, a rising current is applied to the circuit capacitance Ck and the load capacitance Cp from the second resonance block 14 in order to further charge the circuit capacitance Ck and the load capacitance Cp. The electrical potential on the common line CL and the column electrode Zi is gradually increased furthermore during the rising period by the second resonance block 14 depending on time constants of the coil L21, the circuit capacitance Ck, and the load capacitance Cp.

When the constant level period starts, the switching element SW13 is turned on, which applies an electrical potential VB directly derived from the power source B11 to the circuit capacitance Ck via the common line CL. The power source voltage is also applied to the load capacitance Cp via the switching element SW31 and the column electrode Zi. Accordingly, the electrical potential on the common line CL and the column electrode Zi is kept at the power source voltage VB.

When the falling period starts, the switching element SW13 is turned off, the switching elements SW11 and SW21 are turned off simultaneously, and, the switching element SW22 is turned on. Turning on the switching element SW22 allows an electrical potential (current) developed at the circuit capacitance Ck and the load capacitance Cp to be applied (flow) to the capacitor C21 via the switching element SW31 (only from the load capacitance Cp), the common line CL, the coil L22, the diode D22, and the switching element SW22. Specifically, a falling current is applied to the second resonance block 14 from the circuit capacitance Ck and the load capacitance Cp in order to charge the capacitor C21. The electrical potential on the common line CL and the column electrode Zi is gradually decreased during the falling period by the second resonance block 14 depending on time constants of the coil L22, the circuit capacitance Ck, and the load capacitance Cp.

When the electrical potential on the common line CL and the column electrode Zi exhibits a substantially stable condition after the falling period, the switching element SW12 is turned on with the switching element SW22 being kept turned on. Turning on the switching element SW12 allows an electrical potential (current) developed at the circuit capacitance Ck and the load capacitance Cp to be applied (flow) to the capacitor C11 via the switching element SW31 (only from the load capacitance Cp), the common line CL, the coil L12, the diode D12, and the switching element SW12. Specifically, a falling current is applied to the first resonance block 13 from the circuit capacitance Ck and the load capacitance Cp in order to charge the capacitor C11. The electrical potential on the common line CL and the column electrode Zi is gradually decreased furthermore during the falling period of the first resonance block 13 depending on time constants of the coil L12, the circuit capacitance Ck, and the load capacitance Cp. Accordingly, the data pulse $DP_{1i}$ corresponding to $DB_{1i}=1$ is formed on the column electrode Zi.

On finishing the scanning period on the first row electrode (first display line), the switching elements SW31 and SW32 are turned of and on, respectively, because $DB_{2i}=0$ during a scanning period on a second row electrode (second display line) by the row electrode driving circuits 7 and 8. Since the load capacitance Cp is short-circuited by the switching element SW32 during the scanning period on the second row electrode (second display line), the electrical potential on the column electrode Zi is zero and no data pulse is formed.

As the scanning period on the second row electrode (second display line) starts, the rising period starts which firstly turns on the switching element SW11. Turning on the switching element SW11 allows an electrical potential (current) developed at the capacitor C11 to be applied (flow) to the circuit capacitance Ck via the switching element SW11, the coil L11, the diode D11 and the common line CL in order to charge the circuit capacitance Ck. The electrical potential (current) is not applied (flow) to the load capacitance Cp. The electrical potential on the common line CL is gradually increased during the rising period by the first resonance block 13 depending on the time constant of the coil L11 and the circuit capacitance Ck.

When the electrical potential on the common line CL exhibits a substantially stable condition after the rising period, the switching element SW21 is turned on with the switching element SW11 being kept turned on. Turning on the switching element SW21 allows an electrical potential (current) developed at the capacitor C21 to be applied (flow) to the circuit capacitance Ck via the switching element SW21, the coil L21, the diode D21 and the common line CL in order to further charge the circuit capacitance Ck. The electrical potential on the common line CL is gradually increased further during the rising period by the second resonance block 14 depending on the time constant of the coil L21 and the circuit capacitance Ck.

Subsequently, when the constant level period starts, the switching element SW13 is turned on, which applies the electrical potential VB directly derived from the power source B11 to the circuit capacitance Ck via the common line CL. Accordingly, the electrical potential on the common line CL is kept at the power source voltage VB.

When the falling period starts, the switching element SW13 is turned off, the switching elements SW11 and SW21 are turned off simultaneously, and, the switching element SW22 is turned on. Turning on the switching element SW22 allows an electrical potential (current) developed at the circuit capacitance Ck to be applied (flow) to the capacitor C21 of the second resonance block 14 via the common line CL, the coil L22, the diode D22, and the switching element SW22 in order to charge the capacitor C21. The electrical potential on the common line CL is gradually decreased during the falling period by the second resonance block 14 depending on the time constant of the coil L22 and the circuit capacitance Ck.

When the electrical potential on the common line CL exhibits a substantially stable condition after the falling period, the switching element SW12 is turned on with the switching element SW22 being kept turned on. Turning on the switching element SW12 allows an electrical potential (current) developed at the circuit capacitance Ck to be applied (flow) to the capacitor C11 via the common line CL, the coil L12, the diode D12, and the switching element SW12 in order to charge the capacitor C11. The electrical potential on the common line CL is gradually decreased further during the falling period of the first resonance block 13 depending on the time constant of the coil L12 and the circuit capacitance Ck.

On finishing the scanning period on the second row electrode (second display line), consecutive scannings on a third row electrode (third display line) and after are initiated to repeat similar operations of $DB_{1i}=1$ and $DB_{2i}=0$ as described above alternately.

As can be understood in the above description, when the inversion of the logic level in the cell bit data DB is less frequent as shown in FIG. 5, namely, when the address driving power is small, the switching elements SW11 and SW21 are turned on/off simultaneously, and also the switching elements SW12 and SW22 are turned on/off simultaneously. These simultaneous on/off operations reduce the rising period and falling period in each data pulse, which results in a reduction of the period of the cell data writing step Wc. A period obtained by the reduction of the cell data writing step Wc can be allocated for the light emission sustaining step Ic in the same subfield. A rising period and a falling period of the sustain pulses can be increased by, for example, increasing an inductance of the resonance circuit in which the sustain pulses are generated by a resonance operation during the light emission sustaining step Ic. A power recovery ratio during the resonance operation can be therefore improved, which saves power that used to be consumed uselessly.

A repetition of the same logic level in sequence as shown in FIG. 5 causes a gradual increase of electrical potential of the capacitors C11 and C12, which reduces the amplitude of the electrical potential of the common line CL (an electrical potential of the resonance circuit), and therefore decreases the address driving power.

On the other hand, when the inversion of the logic level in the cell bit data DB is more frequent as shown in FIG. 6, namely, when the address driving power is large, the switching elements SW11 and SW21 are not turned on/off simultaneously, and also the switching elements SW12 and SW22 are not turned on/off simultaneously. These non-simultaneous on/off operations increase the rising period and falling period of the data pulses, which results in an improvement of the power recovery ratio in a resonance operation during the cell data writing step Wc, and saves power that used to be consumed uselessly.

The operation shown in FIG. 5 is a single step resonance operation in which the first resonance block 13 and the second resonance block 14 in the resonance circuit 11 resonate simultaneously, and the operation shown in FIG. 6 is a complex resonance operation in which the first resonance block 13 and the second resonance block 14 resonate as a complex operation. In addition, it is possible toresonate the first resonance block 13 and the second resonance block 14 alternately in the single step resonance operation.

Figure 7:
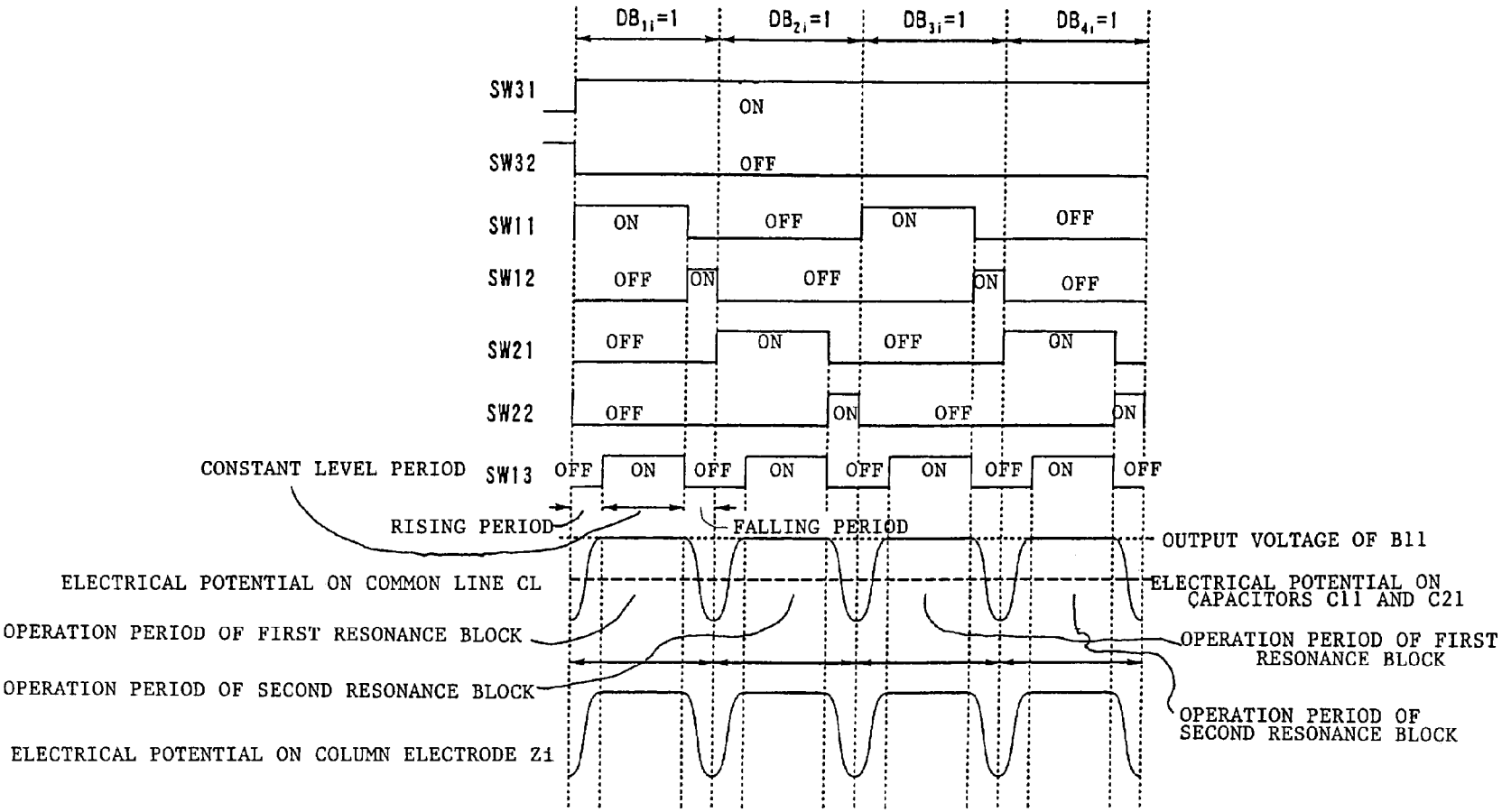
FIG. 7 is a diagram showing on/off states of each switching element by an alternate resonance operation and variations of electrical potentials on the common line and the column electrode, when the inversion of the logic level in cell bit data is less frequent.

The alternate resonance operation will be described when all the logic levels of all cell bit data DB are "1" as shown in FIG. 7, namely, in a state in which the inversion of the cell bit data is less frequent. In this case, the switching elements SW31 and SW32 are turned on and off, respectively, because $DB_{1i}=1$ during a scanning period on a first row electrode by the row electrode driving circuits 7 and 8.

As the scanning period on the first row electrode (first display line) starts, the rising period starts which firstly turns on the switching element SW11. Turning on the switching element SW11 allows an electrical potential (current) developed at the capacitor C11 to be applied (flow) to the circuit capacitance Ck via the switching element SW11, the coil L11, the diode D11 and the common line CL. The electrical potential (current) is also applied (flow) to the load capacitance Cp of the column electrode Zi via the switching element SW31. A rising current is applied to the circuit capacitance Ck and the load capacitance Cp from the first resonance block 13 in order to charge the circuit capacitance Ck and the load capacitance Cp. The electrical potential on the common line CL and the column electrode Zi is gradually increased during the rising period depending on the time constants of the coil L11, the circuit capacitance Ck and the load capacitance Cp.

Subsequently, when the constant level period starts, the switching element SW13 is turned on, which applies the electrical potential VB directly derived from the power source B11 to the circuit capacitance Ck via the common line CL. The power source voltage is also applied to the load capacitance Cp via the switching element SW31 and the column electrode Zi. Accordingly, the electrical potential on the common line CL and the column electrode Zi is kept at the maximum potential equal to the power source voltage VB.

When the falling period starts, the switching element SW13 is turned off, the switching element SW11 is turned off, and, the switching element SW12 is turned on. Turning on the switching element SW12 allows an electrical potential (current) developed at the circuit capacitance Ck and the load capacitance Cp to be applied (flow) to the capacitor C11 via the switching element SW31 (only from the load capacitance Cp), the common line CL, the coil L12, the diode D12, and the switching element SW12. A falling current is applied to the first resonance block 13 from the circuit capacitance Ck and the load capacitance Cp in order to charge the capacitor C11. The electrical potential on the common line CL and the column electrode Zi is gradually decreased during the falling period depending on the time constants of the coil L12, the circuit capacitance Ck and the load capacitance Cp. Accordingly, the data pulse $DP_{1i}$ corresponding to $DB_{1i}=1$ is formed on the column electrode Zi.

On finishing the scanning period on the first row electrode (first display line), the switching element SW12 is turned off, a scanning on a second row electrode is initiated to start the rising period corresponding to $DB_{2i}=1$, and the switching element SW21 is turned on. Turning on the switching element SW21 allows an electrical potential (current) developed at the capacitor C21 to be applied (flow) to the circuit capacitance Ck via the switching element SW21, the coil L21, the diode D21 and the common line CL. The electrical potential (current) is also applied (flow) to the load capacitance Cp of the column electrode Zi via the switching element SW31. A rising current is applied to the circuit capacitance Ck and the load capacitance Cp from the second resonance block 14 in order to charge the circuit capacitance Ck and the load capacitance Cp. The electrical potential on the common line CL and the column electrode Zi is gradually increased during the rising period depending on the time constants of the coil L12, the circuit capacitance Ck and the load capacitance Cp.

Subsequently, when the constant level period starts, the switching element SW13 is turned on, which maintains the electrical potential on the common line CL and the column electrode Zi at a maximum potential equal to the power source voltage VB as described above.

When the falling period starts, the switching element SW13 is turned off and the switching element SW21 is turned off simultaneously. Furthermore, the switching element SW22 is turned on. Turning on the switching element SW22 allows an electrical potential (current) developed at the circuit capacitance Ck and the load capacitance Cp to be applied (flow) to the capacitor C21 via the switching element SW31 (only from the load capacitance Cp), the common line CL, the coil L22, the diode D22, and the switching element SW22. A falling current is applied to the second resonance block 14 from the circuit capacitance Ck and the load capacitance Cp in order to charge the capacitor C21. The electrical potential on the common line CL and the column electrode Zi is gradually decreased during the falling period depending on the time constants of the coil L22, the circuit capacitance Ck and the load capacitance Cp. Accordingly, the data pulse $DP_{2i}$ corresponding to $DB_{2i}=1$ is formed on the column electrode Zi.

On finishing the scanning period on the second row electrode (second display line), a scanning on a third row electrode (third display line) is initiated to start the rising period corresponding to $DB_{3i}=1$, followed by the constant level period and the falling period so as to alternately repeat the resonance operations of the first resonance block 13 and the second resonance block 14 as described above.

When one of the bits in a bit series $DB_{1i}$, $DB_{2i}$, $DB_{3i}$, $DB_{4i}$, . . . , and $DB_{ni}$ for the column electrode Zi is 0, the switching elements SW31 and SW32 are turned off and on, respectively, during the scanning period for the row electrode corresponding to 0 although this is not shown in FIG. 7. Accordingly, an electrical charge or discharge on the load capacitance Cp via the switching element SW31 is not carried out, and therefore the electrical potential on the column electrode Zi will be 0V.

In FIGS. 5 through 7, the on/off operation of each switching element and respective variations of the electrical potential of the common line CL and the column electrode Zi are shown only for the cell bit data DB of $DB_{1i}$, $DB_{2i}$, $DB_{3i}$ and $DB_{4i}$, and the rest of the cell bit data $DB_{5i}$ through $DB_{ni}$ are omitted as they exhibit similar variations.

A comparison of the resonance operations shown in FIGS. 5 through 7 indicates the ratio of the resonance periods among the simultaneous single step resonance operation in FIG. 5, the alternate single step resonance operation in FIG. 7 and the complex resonance operation in FIG. 6 to be 0.7, 1 and 2, respectively. The comparison also indicates that the magnitude of data writing power (the address driving power) for each operation can be rated as large, medium and small. Accordingly, a resonance operation can be selectively switched over depending on the magnitude of the address driving power to be expected by the data writing on the entire display panel.

Although the pulse-wise timing operation are described above as one example in FIG. 7 for switching over the first resonance block 13 and the second resonance block 14, a field-wise timing operation or a subfield-wise timing operation may be also available.

In the above described embodiment, the address driving power is determined based on the state of inversions of the logic level of the cell data. Specifically, the address driving power is determined to be relatively small when the inversion of the logic level of the cell data occurs less. On the other hand, the address driving power is determined to be relatively large when the inversion of the logic level of the cell data occurs more. Alternately the magnitude of the address driving power may be determined based on the type of the supplied picture signal (switching over of the input signal) or on the magnitude of electrical currents (address driving currents) measured during the data writing period.

Specifically, the rising period and the falling period of the data pulse should be reduced in the case of a video signal input (NTSC input, PAL input) because the address driving power is determined to be relatively small, and the rising period and the falling period of the data pulse should be increased in the case of a PC (personal computer) input because the address driving power is determined to be relatively large. Moreover, the rising period and the falling period of the data pulse should be reduced when a small current (address driving current) flows in during the data writing period because the address driving power is determined to be relatively small, and the rising period and the falling period of the data pulse should be increased when a large current (address driving current) flows in during the data writing period because the address driving power is determined to be relatively large.

The single step resonance operation is employed and the rising period and the falling period of the data pulse are decreased in the case of a picture input which has a correlation between adjacent lines such as a video signal input (NTSC input, PAL input). This reduces the address period, making it possible to allocate the period obtained by the reduction for the sustaining step so as to increase the rising period and the falling period of the sustain pulse, and save power during the sustain step that used to be consumed uselessly.

The multi-step resonance operation (such as two-step resonance operation) is employed and the rising period and the falling period of the data pulse are increased in the case of a picture input which has no correlation between adjacent lines such as a PC signal input, in order to further save the address driving power. In this case, a comparative reduction of the sustain period is necessary because of the increase of the address period, which can be done by reducing the number of sustain pulses.

As described above, the driving apparatus comprises cell data generating means which generates cell data having a series of bits indicating light emitting state or non-light emitting state of each cell on each column electrode of the display panel based on the picture signal, pulse generating means which subsequently generates a power pulse having a pulse width corresponding to one bit of the cell data, and pulse supplying means provided on each column electrode which supplies the power pulse as the driving pulse to a cell of a column electrode when a corresponding bit in the cell data for the column electrode indicates a logic level of light emitting, wherein the pulse generating means has determining means to determine a magnitude of a power during a writing period of said cell data and adjusting means which varies a rising period and a falling period of the power pulse depending on the determining result by the determining means. Therefore the driving apparatus can appropriately adjust the rising period and the falling period of the data pulses corresponding to the address driving power, to save power that used to be consumed uselessly in a whole display apparatus by optimizing the balance between the address period and the sustain period.

This application is based on Japanese patent applications Nos. 2002-273327 and 2002-54058 which are incorporated herein by reference.

What is claimed is:

1. A driving apparatus for a display panel which applies a driving pulse based on a picture signal on each column electrode of the display panel having a plurality of row electrodes and a plurality of column electrodes perpendicularly crossing said row electrodes so as to form cells with a capacitive load in each crossing portion of the electrodes, the apparatus comprising:

a cell data generator which generates cell data having a series of bits indicating a light emitting state or a non-light emitting state of each cell on each column electrode of the display panel based on said picture signal;

a pulse generator which generates a power pulse having a pulse width corresponding to one bit of said cell data; and a pulse supplier provided on each column electrode which supplies said power pulse as said driving pulse to a cell of a column electrode when a corresponding bit in the cell data for the column electrode indicates a light emitting logic level;

wherein said pulse generator includes a determining unit which determines a magnitude of power during a writing period of said cell data and an adjusting unit which varies a rising period and a falling period of said power pulse depending on a result provided by said determining unit;

wherein said pulse generator comprises a plurality of resonance circuits which vary the rising period and the falling period of said power pulse using at least one of said plurality of resonance circuits;

wherein said plurality of resonance circuits has a common output terminal so as to vary the rising period and the falling period of said power pulse by varying operation timings of the plurality of resonance circuits in relation to each other depending on the result provided by said determining unit;

wherein each of said plurality of resonance circuits comprises:

a capacitor connecting to a ground potential at its one end;

a discharge route having a first switching element and a first inductance device connected in series between the other end of said capacitor and said output terminal so as to discharges an electrical potential developed at said capacitor; and a charge route having a second switching element and a second inductance device connected in series between the other end of said capacitor and said output terminal so as to charge an electrical potential to said capacitor; and wherein said pulse generator includes a third switching element to apply a specified maximum potential to said output terminal.

2. The driving apparatus for a display panel according to claim 1, wherein said pulse generator reduces the rising period and the falling period of said power pulse when the power during the writing period of said cell data is determined as small by the determining unit, and increases the rising period and the falling period of said power pulse when the power during the writing period of said cell data is determined as large by the determining unit.

3. The driving apparatus for a display panel according to claim 1, wherein said pulse generator periodically repeats a rising step to turn off said third switching element and to turn on only said first switching element in each of the plurality of resonance circuits, a constant level step to turn on said third switching element, and a falling step to turn off said third switching element and to turn on only said second switching element in each of said plurality of resonance circuits.

4. The driving apparatus for a display panel according to claim 1, wherein said pulse generator reduces the rising period and the falling period of said power pulse by simultaneously turning said first switching element and second switching element on/off in each resonance circuit when the power during the writing period of said cell data is determined as small by the determining unit, and increases the rising period and the falling period of said power pulse by turning said first switching element and second switching element on/off non-simultaneously in each resonance circuit when the power during the writing period of said cell data is determined as large by the determining unit.

5. The driving apparatus for a display panel according to claim 1, wherein said determining unit determines the power during a writing period of said cell data as large when said picture signal is input from a personal computer, and determines the power during the writing period of said cell data as small when said picture signal is input from a video.

6. The driving apparatus for a display panel according to claim 1, wherein said determining unit determines the power during a writing period of said cell data as large when a logic level of at least two consecutive bits in said cell data do not continue in the same level or inversion of the logic level is relatively frequent, and determines the power during the writing period of said cell data as small when the logic level of the at least two consecutive bits in said cell data continue in the same level or inversion of the logic level is less frequent.

7. The driving apparatus for a display panel according to claim 1, wherein said determining unit determines a magnitude of writing power based on an electrical current flowing during a writing period of said cell data.

8. The driving apparatus for a display panel according to claim 1, wherein said pulse generator alternately repeats a first resonance circuit operation having a rising step to turn off said third switching element and to turn on only said first switching element of a first resonance circuit among said plurality of resonance circuits, a constant level step to turn on said third switching element, and a falling step to turn off said third switching element and to turn on only said second switching element of said first resonance circuit, and a second resonance circuit operation having a rising step to turn off said third switching element and to turn on only said first switching element of a second resonance circuit among said plurality of resonance circuits, a constant level step to turn on said third switching element, and a falling step to turn off said third switching element and to turn on only said second switching element of said second resonance circuit.

9. A driving apparatus for a display panel which applies a driving pulse based on a picture signal on each column electrode of the display panel having a plurality of row electrodes and a plurality of column electrodes perpendicularly crossing said row electrodes so as to form cells with a capacitive load in each crossing portion of the electrodes, the apparatus comprising:

a cell data generator which generates cell data having a series of bits indicating a light emitting state or a non-light emitting state of each cell on each column electrode of the display panel based on said picture signal;

a pulse generator which generates a power pulse having a pulse width corresponding to one bit of said cell data; and a pulse supplier provided on each column electrode which supplies said power pulse as said driving pulse to a cell of a column electrode when a corresponding bit in the cell data for the column electrode indicates a light emitting logic level;

wherein said pulse generator includes a determining unit to determine a magnitude of power during a writing period of said cell data and an adjusting unit which varies a rising period and a falling period of said power pulse depending on a result provided by said determining unit;

wherein said pulse generator has a plurality of resonance circuits with a common output terminal so as to vary the rising period and the falling period of said power pulse by varying operation timings of the plurality of resonance circuits in relation to each other depending on the result provided by said determining unit;

wherein each of said plurality of resonance circuits comprises:

a capacitor connecting to a ground potential at its one end;

a discharge route having a first switching element and a first inductance device connected in series between the other end of said capacitor and said output terminal so as to discharges an electrical potential developed at said capacitor; and a charge route having a second switching element and a second inductance device connected in series between the other end of said capacitor and said output terminal so as to charge an electrical potential to said capacitor; and wherein said pulse generator includes a third switching element to apply a specified maximum potential to said output terminal.

10. The driving apparatus for a display panel according to claim 9, wherein said pulse generator periodically repeats a rising step to turn off said third switching element and to turn on only said first switching element in each of the plurality of resonance circuits, a constant level step to turn on said third switching element, and a falling step to turn off said third switching element and to turn on only said second switching element in each of said plurality of resonance circuits.

11. The driving apparatus for a display panel according to claim 9, wherein said pulse generator reduces the rising period and the falling period of said power pulse by simultaneously turning said first switching element and second switching element on/off in each resonance circuit when the power during the writing period of said cell data is determined as small by the determining unit, and increases the rising period and the falling period of said power pulse by turning said first switching element and second switching element on/off non-simultaneously in each resonance circuit when the power during the writing period of said cell data is determined as large by the determining unit.

12. A driving apparatus for a display panel which applies a driving pulse based on a picture signal on each column electrode of the display panel having a plurality of row electrodes and a plurality of column electrodes perpendicularly crossing said row electrodes so as to form cells with a capacitive load in each crossing portion of the electrodes, the apparatus comprising:

a cell data generator which generates cell data having a series of bits indicating a light emitting state or a non-light emitting state of each cell on each column electrode of the display panel based on said picture signal;

a pulse generator which generates a power pulse having a pulse width corresponding to one bit of said cell data; and a pulse supplier provided on each column electrode which supplies said power pulse as said driving pulse to a cell of a column electrode when a corresponding bit in the cell data for the column electrode indicates a light emitting logic level;

wherein said pulse generator includes a determining unit to determine a magnitude of power during a writing period of said cell data and an adjusting unit which varies a rising period and a falling period of said power pulse depending on a result provided by said determining unit; and wherein said determining unit determines a magnitude of writing power based on an electrical current flowing during a writing period of said cell data.

13. The driving apparatus for a display panel according to claim 9, wherein said pulse generator alternately repeats a first resonance circuit operation having a rising step to turn off said third switching element and to turn on only said first switching element of a first resonance circuit among said plurality of resonance circuits, a constant level step to turn on said third switching element, and a falling step to turn off said third switching element and to turn on only said second switching element of said first resonance circuit, and a second resonance circuit operation having a rising step to turn off said third switching element and to turn on only said first switching element of a second resonance circuit among said plurality of resonance circuits, a constant level step to turn on said third switching element, and a falling step to turn off said third switching element and to turn on only said second switching element of said second resonance circuit.

* * * * *